US012152307B2

(12) United States Patent
Hamaya et al.

(10) Patent No.: US 12,152,307 B2
(45) Date of Patent: Nov. 26, 2024

(54) YTTRIUM FLUORIDE SPRAYED COATING, SPRAY MATERIAL THEREFOR, AND CORROSION RESISTANT COATING INCLUDING SPRAYED COATING

(71) Applicant: Shin-Etsu Chemical Co., Ltd., Tokyo (JP)

(72) Inventors: Noriaki Hamaya, Echizen (JP); Yasushi Takai, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 1039 days.

(21) Appl. No.: 17/101,137

(22) Filed: Nov. 23, 2020

(65) Prior Publication Data

US 2021/0079509 A1 Mar. 18, 2021

Related U.S. Application Data

(62) Division of application No. 15/479,451, filed on Apr. 5, 2017, now abandoned.

(30) Foreign Application Priority Data

Apr. 12, 2016 (JP) ..... 2016-079258

(51) Int. Cl.
*C23C 4/11* (2016.01)
*C23C 4/02* (2006.01)
(Continued)

(52) U.S. Cl.
CPC ..... *C23C 4/11* (2016.01); *C23C 4/02* (2013.01); *C23C 4/04* (2013.01); *C23C 4/126* (2016.01);
(Continued)

(58) Field of Classification Search
CPC ..... C23C 4/11; C23C 28/042; C23C 4/04; C23C 28/04
See application file for complete search history.

(56) References Cited

U.S. PATENT DOCUMENTS 6,576,354 B2 6/2003 Tsukatani et al.
6,685,991 B2 2/2004 Wataya et al.
(Continued)

FOREIGN PATENT DOCUMENTS

JP 2002-241971 A 8/2002
JP 3523222 B2 4/2004
(Continued)

OTHER PUBLICATIONS

Office Action dated May 16, 2022, issued in counterpart KR Application No. 10-2022-0015955. (4 pages).
(Continued)

*Primary Examiner* — Laura A Auer
(74) *Attorney, Agent, or Firm* — WHDA, LLP

(57) ABSTRACT

An yttrium fluoride sprayed coating having a thickness of 10-500 μm, an oxygen concentration of 1-6 wt %, and a hardness of 350-470 HV is deposited on a substrate surface. The yttrium fluoride sprayed coating exhibits excellent corrosion resistance in a halogen-base gas atmosphere or halogen-base gas plasma atmosphere, functions to protect the substrate from damage by acid penetration during acid cleaning, and minimizes particle generation from a reaction product and due to spall-off from the coating.

15 Claims, 4 Drawing Sheets

(51) Int. Cl.

| | |
|---|---|
| ***C23C 4/04*** | (2006.01) |
| ***C23C 4/126*** | (2016.01) |
| ***C23C 4/134*** | (2016.01) |
| ***C23C 28/04*** | (2006.01) |

(52) U.S. Cl.
CPC ..... *C23C 4/134* (2016.01); *C23C 28/04* (2013.01); *C23C 28/042* (2013.01)

(56) References Cited

U.S. PATENT DOCUMENTS

| | | | | |
|---|---|---|---|---|
| 6,852,433 | B2 | 2/2005 | Maeda | |
| 7,462,407 | B2 | 12/2008 | Maeda et al. | |
| 7,655,328 | B2 | 2/2010 | Maeda et al. | |
| 7,968,205 | B2 | 6/2011 | Nakano et al. | |
| 2009/0214825 | A1 | 8/2009 | Sun et al. | |
| 2013/0052451 | A1 | 2/2013 | Sano et al. | |
| 2013/0122283 | A1 | 5/2013 | Hamaya et al. | |
| 2014/0057078 | A1* | 2/2014 | Hamaya ..... | C23C 4/134 428/402 |
| 2015/0096462 | A1 | 4/2015 | Fukagawa et al. | |
| 2016/0326623 | A1 | 11/2016 | Nagayama et al. | |
| 2018/0362359 | A1 | 12/2018 | Sato et al. | |

FOREIGN PATENT DOCUMENTS

| | | | |
|---|---|---|---|
| JP | 3672833 | B2 | 7/2005 |
| JP | 3894313 | B2 | 3/2007 |
| JP | 4006596 | B2 | 11/2007 |
| JP | 2011-514933 | A | 5/2011 |
| JP | 4905697 | B2 | 3/2012 |
| JP | 4985928 | B2 | 7/2012 |
| JP | 5396672 | B2 | 1/2014 |
| JP | 2014-040634 | A | 3/2014 |
| JP | 2016-037653 | A | 3/2016 |
| JP | 2016-211070 | A | 12/2016 |
| WO | 2011/135786 | A1 | 11/2011 |

OTHER PUBLICATIONS

Office Action dated Feb. 27, 2018, issued in counterpart Japanese application No. 2016-079258, with English translation. (7 pages).
Office Action dated Jun. 21, 2018, issued in counterpart Japanese application No. 2016-079258, with English translation. (7 pages).

* cited by examiner

YTTRIUM FLUORIDE SPRAYED COATING, SPRAY MATERIAL THEREFOR, AND CORROSION RESISTANT COATING INCLUDING SPRAYED COATING

CROSS-REFERENCE TO RELATED APPLICATION

This application claims divisional status from U.S. application Ser. No. 15/479,451 filed Apr. 5, 2017, which in turn claims priority to Patent Application No. 2016-079258 filed in Japan on Apr. 12, 2016, the entire contents of which are hereby incorporated by reference.

TECHNICAL FIELD

This invention relates to an yttrium fluoride sprayed coating suited for use as a low-dusting corrosion resistant coating on parts which are exposed to a corrosive plasma atmosphere such as a corrosive halogen-base gas in the processes for manufacturing semiconductor, liquid crystal, organic EL and inorganic EL devices, and a corrosion resistant coating of a multilayer structure including the yttrium fluoride sprayed coating.

BACKGROUND ART

In the prior art process for fabricating semiconductor devices, a dielectric film etching system, gate etching system, CVD system and the like are used. Since the high-integration technology involving the micropatterning process often utilizes a plasma, the chamber members must have corrosion resistance in the plasma. Also, the members are formed of high purity materials in order to prevent impurity contamination.

Typical treatment gases for use in the semiconductor device fabricating process are halogen-base gases, for example, fluorine-base gases such as $SF_6$, $CF_4$, $CHF_3$, $ClF_3$, HF and $NF_3$ and chlorine-base gases such as $Cl_2$, $BCl_3$, HCl, $CCl_4$ and $SiCl_4$. The halogen-base gas is introduced into a chamber, where a high frequency energy such as microwave is applied to create a plasma from the gas, with which treatment is carried out. The chamber members exposed to the plasma are required to have corrosion resistance.

The equipment used for plasma treatment typically includes parts or components which are provided with corrosion resistant coatings on their surface. For example, parts or members of metallic aluminum substrates or aluminum oxide ceramic substrates having coatings formed thereon by spraying yttrium oxide (Patent Document 1) and yttrium fluoride (Patent Documents 2 and 3) to the substrate surface are known to be fully corrosion resistant and used in practice. Examples of the material for protecting the inner wall of chamber members exposed to plasma include ceramics such as quartz and alumina, surface anodized aluminum, and sprayed coatings on ceramic substrates. Further, Patent Document 4 discloses a plasma resistant member including a layer of Group 3A metal (in the Periodic Table) in a surface region exposed to a plasma in a corrosive gas. The metal layer typically has a thickness of 50 to 200 μm.

However, the ceramic members suffer from problems including a high working cost and dusting, that is, if the member is exposed to a plasma in a corrosive gas atmosphere for a long time, the reactive gas causes corrosion to proceed from the surface whereby surface-constituting crystal grains spall off, generating particles. Spall-off particles deposit on a semiconductor wafer or lower electrode, adversely affecting the production yield of etching step. It is thus necessary to remove the reaction product that causes particle contamination. Even when the member surface is formed of a material having corrosion resistance to plasma, it is still necessary to prevent metal contamination from the substrate. Further in the case of anodized aluminum and sprayed coatings, if the substrate to be coated is a metal, contamination with the metal can adversely affect the quality yield of etching step.

On the other hand, once a reaction product has deposited on the inner wall of the chamber under the influence of plasma, it is necessary to remove the reaction product by cleaning. The reaction product reacts with airborne moisture or water in the case of aqueous cleaning, to generate an acid which, in turn, penetrates to the interface between the sprayed coating and the metal substrate, causing damage to the substrate interface. This can reduce the adhesion strength at the interface and cause the coating to be stripped, detracting from the essential plasma resistance.

In the semiconductor device fabricating process, pattern size reduction and wafer diameter enlargement are in progress. Particular in the dry etching process, the plasma resistance capability of chamber members has a substantial impact. Metal contamination associated with corrosion of chamber members and particle generation from the reaction product or by spall-off from the coating are problems.

As the current semiconductor technology aims at higher integration, the size of interconnections is approaching to 20 nm or less. During etching step in the process for fabricating highly integrated semiconductor devices, yttrium-base particles may spall off the surface of yttrium-base coatings on the parts during etching treatment and fall onto silicon wafers to interfere with the etching treatment. This causes to reduce the production yield of semiconductor devices. There is a tendency that the number of yttrium-base particles spalling off the yttrium-base coating surface is large at the early stage of etching treatment and decreases with the lapse of etching time. Patent Documents 5 to 9 relating to the spraying technology are also incorporated herein by reference.

CITATION LIST

Patent Document 1: JP 4006596 (U.S. Pat. No. 6,852,433)
Patent Document 2: JP 3523222 (U.S. Pat. No. 6,685,991)
Patent Document 3: JP-A 2011-514933 (US 20090214825)
Patent Document 4: JP-A 2002-241971
Patent Document 5: JP 3672833 (U.S. Pat. No. 6,576,354)
Patent Document 6: JP 4905697 (U.S. Pat. No. 7,655,328)
Patent Document 7: JP 3894313 (U.S. Pat. No. 7,462,407)
Patent Document 8: JP 5396672 (US 2015096462)
Patent Document 9: JP 4985928

SUMMARY OF INVENTION

An object of the invention is to provide a corrosion resistant coating which is effective for suppressing the penetration from member surface of halogen-base corrosive gas used in the semiconductor processing system, has sufficient corrosion resistance with respect to a plasma thereof (i.e., plasma resistance), protects as much as possible the substrate from damage by acid penetration even after repeated acid cleaning for removing any reaction product deposited on the member surface during plasma etching, and minimizes metal contamination and particle generation from the reaction product and due to spall-off from the coating.

The inventors have found that a thermally sprayed yttrium fluoride coating having an yttrium fluoride crystal structure containing $YF_3$, $Y_5O_4F_7$, YOF or the like, an oxygen concentration of 1 to 6% by weight, and a hardness of at least 350 HV, and especially a crack amount of up to 5% and a porosity of up to 5%, both based on the surface area of the coating, and a carbon content of up to 0.01% by weight exhibits satisfactory corrosion resistance with respect to a plasma, is effective for preventing the substrate from damage by acid penetration during acid cleaning, and minimizes particle generation.

The inventors have also found that an yttrium fluoride sprayed coating having a crack amount of up to 5% is readily deposited by using a granulated powder consisting essentially of 9 to 27% by weight of $Y_5O_4F_7$ and the balance of $YF_3$, or a powder mixture consisting essentially of 95 to 85% by weight of a granulated powder of yttrium fluoride and 5 to 15% by weight of a granulated powder of yttrium oxide as the spray material; and that when a lower layer in the form of a rare earth oxide sprayed coating having a porosity of up to 5% is combined with the yttrium fluoride sprayed coating, the resulting composite coating exerts a better acid penetration suppressing effect, is more effective for preventing damage, and provides more reliable corrosion resistant performance.

In one aspect, the invention provides an yttrium fluoride sprayed coating deposited on a substrate surface, having a thickness of 10 to 500 μm, an oxygen concentration of 1 to 6% by weight, and a hardness of at least 350 HV.

Preferably, the sprayed coating has a crack amount of up to 5% based on the surface area of the coating and/or a porosity of up to 5% based on the surface area of the coating.

Also preferably the sprayed coating has an yttrium fluoride crystal structure composed of $YF_3$ and at least one compound selected from the group consisting of $Y_5O_4F_7$, YOF and $Y_2O_3$.

Also preferably the sprayed coating has a carbon content of up to 0.01% by weight.

In another aspect, the invention provides an yttrium fluoride spray material for forming the yttrium fluoride sprayed coating defined above, which is a granulated powder consisting essentially of 9 to 27% by weight of $Y_5O_4F_7$ and the balance of $YF_3$, or a powder mixture consisting essentially of 95 to 85% by weight of a granulated powder of yttrium fluoride and 5 to 15% by weight of a granulated powder of yttrium oxide.

In a further aspect, the invention provides a corrosion resistant coating having a multilayer structure comprising a lower layer in the form of a rare earth oxide sprayed coating having a thickness of 10 to 500 μm and a porosity of up to 5% and an outermost surface layer in the form of the yttrium fluoride sprayed coating defined above.

The rare earth element of the rare earth oxide sprayed coating is typically at least one element selected from the group consisting of Y, Sc, Gd, Tb, Dy, Ho, Er, Tm, Yb and Lu.

Advantageous Effects of Invention

The yttrium fluoride sprayed coating of the invention exhibits excellent corrosion resistance during treatment in a halogen-base gas atmosphere or halogen-base gas plasma atmosphere, functions to protect the substrate from damage by acid penetration during acid cleaning, and minimizes particle generation from the reaction product and due to spall-off from the coating. From the spray material, the yttrium fluoride sprayed coating is readily obtained. The corrosion resistant coating obtained by combining the yttrium fluoride sprayed coating with a lower layer in the form of a rare earth oxide sprayed coating having a porosity of up to 5% enhances the effect of suppressing acid penetration and the effect of preventing the coating itself from damage, offering a more reliable corrosion resisting performance.

BRIEF DESCRIPTION OF DRAWINGS

FIG. 2 is obtained by enlarging a central portion of FIG. 1 and image processing so that cracks look white.

FIG. 4 is obtained by enlarging a central portion of FIG. 3 and image processing so that cracks look white.

DESCRIPTION OF PREFERRED EMBODIMENTS

Figure 1:
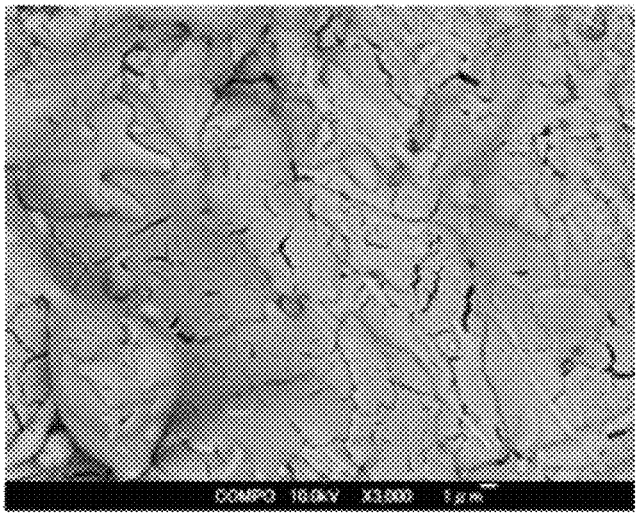
FIG. 1 is an electron micrograph showing a surface of an yttrium fluoride sprayed coating deposited in Comparative Example 1.

The thermally sprayed coating of the invention is an yttrium fluoride sprayed coating which exhibits excellent corrosion resistance with respect to a halogen-base gas atmosphere or halogen-base gas plasma atmosphere, and has an yttrium fluoride crystal structure containing $YF_3$, $Y_5O_4F_7$, YOF and the like, preferably an yttrium fluoride crystal structure consisting of $YF_3$ and at least one compound selected from among $Y_5O_4F_7$, YOF and $Y_2O_3$.

As defined above, the yttrium fluoride sprayed coating has an oxygen concentration of 1 to 6% by weight and a hardness of at least 350 HV. The yttrium fluoride sprayed coating having a low oxygen concentration and a high hardness is of dense film quality containing less cracks and less open pores, which is effective for suppressing particle contamination and penetration of halogen-base corrosive gases. The preferred oxygen concentration is in a range of 2 to 4.8% by weight and the preferred hardness is in a range of at least 250 HV, more preferably 350 to 470 HV. The sprayed coating should preferably have a crack amount or cracked area of up to 5%, more preferably up to 4%, based on the surface area of the coating. Also the sprayed coating should preferably have a porosity of up to 5%, more preferably up to 3%, based on the surface area of the coating. The crack amount and porosity may be quantitated by image analysis of a sprayed coating surface, specifically by determining a percentage of the relevant area relative to the overall image area. It is noted that when the coating is used in a cut state, the area of the cross section is included in the surface area of the coating. The detail and measuring method of crack amount and porosity will be described later.

Although the carbon content is not critical, the sprayed coating preferably has a carbon content of up to 0.01% by weight. Such a minimal carbon content is effective for suppressing any distortion of the crystal system caused by carbon, and a change of film quality under the influence of plasma gas and heat, achieving stabilization of film quality. The carbon content is more preferably up to 0.005% by weight.

The yttrium fluoride of which the sprayed coating is made is inert to a halogen-base plasma gas and effective for suppressing particle generation resulting from reactive gas and thus minimizing any process variation during semiconductor device fabrication. The yttrium fluoride preferably has a yttrium fluoride crystal structure consisting of $YF_3$ and at least one compound selected from $Y_5O_4F_7$, YOF and $Y_2O_3$ as mentioned above, but is not limited thereto.

Some rare earth fluorides have a phase transition point depending on the identity of rare earth element. For example, fluorides of Y, Sm, Eu, Gd, Er, Tm, Yb and Lu undergo a phase change and cracking upon cooling from the sintering temperature. It is thus difficult to manufacture sintered bodies thereof. The main cause resides in their crystal structure. For example, an yttrium fluoride sprayed coating has crystal structures of two types, high- and low-temperature types, with a transition temperature of 1355K. Via phase transition, its density changes from the high-temperature type structure (hexagonal) density of 3.91 $g/cm^3$ to the low-temperature type structure (orthorhombic) density of 5.05 $g/cm^3$, with this volume reduction inducing surface cracks. In contrast, if a trace of $Y_2O_3$ is added to yttrium fluoride, for example, then surface cracks are reduced because the crystal structure is partially stabilized to change the crack-generating morphology. According to the invention, the sprayed coating is preferably of an yttrium fluoride crystal structure consisting of $YF_3$ and at least one compound selected from $Y_5O_4F_7$, YOF and $Y_2O_3$ as mentioned above, which is effective for suppressing crack generation.

The thickness of the sprayed coating is in a range of 10 to 500 μm, preferably 30 to 300 μm. If the coating is less than 10 μm, it may be less corrosion resistant with respect to the halogen-based gas atmosphere or halogen-based gas plasma atmosphere and less effective for suppressing the generation of particle contamination. If the coating is more than 500 μm, an improvement corresponding to the thickness increment is not expectable and failures such as coating strip by thermal stress may occur.

The yttrium fluoride sprayed coating is preferably prepared by spraying the spray material defined below although the method is not limited thereto. An yttrium fluoride spray material is obtained by mixing 95 to 85% by weight of $YF_3$ source powder with 5 to 15% by weight of $Y_2O_3$ source powder, granulating the powder mixture such as by spray drying, and firing the granulated powder in vacuum or inert gas atmosphere at a temperature of 600 to 1,000° C., preferably 700 to 900° C. for 1 to 12 hours, preferably 2 to 5 hours into a single granulated powder. Notably, each of the source powders is preferably a collection of single particles having a particle size ($D_{50}$) of 0.01 to 3 μm, and the granulated powder after firing preferably has a particle size ($D_{50}$) of 10 to 60 μm. It is confirmed by XRD analysis that the thus fired powder (granulated powder) has a crystal structure which is a mixture of $Y_5O_4F_7$ and $YF_3$, specifically consisting of 9 to 27% by weight of $Y_5O_4F_7$ and the balance of $YF_3$. The fired powder (single granulated powder) may be used as the spray material from which the inventive sprayed coating is formed. An unfired powder mixture obtained by mixing 95 to 85% by weight of $YF_3$ source powder (granulated powder) with 5 to 15% by weight of $Y_2O_3$ source powder (granulated powder) may also be used as the spray material.

When thermal spraying is carried out using the fired powder (single granulated powder) or the unfired powder mixture as the spray material, a sprayed coating having an yttrium fluoride crystal structure consisting essentially of $YF_3$ and at least one compound selected from $Y_5O_4F_7$, YOF and $Y_2O_3$ is obtained. The thus sprayed coating is a consolidated film having least cracks in its surface and a hardness of about 350 to 470 HV. The sprayed coating has an oxygen content of 2 to 4% by weight. Using the spray material defined above, the porosity of the coating may be reduced, specifically to 5% or less.

As mentioned previously, the sprayed coating preferably has a crack amount of up to 5% based on the surface area thereof. One effective means for reducing the crack amount is by polishing the surface of the sprayed coating. That is, cracks may be removed by polishing the yttrium fluoride coating sprayed as above to remove a surface layer of 10 to 50 μm thick. Even after cracks in the outermost surface layer are removed by polishing, if the remaining coating has a low hardness and a substantial porosity, then it does not assume a dense film quality. It is then necessary that even after removal of cracks by polishing, the coating maintain a high hardness of at least 350 HV and a low porosity. On the other hand, the advantage of the means of reducing cracks by surface grinding or polishing is that since the surface roughness is reduced by polishing, the specific surface area of the coating at its surface is reduced so that initial particles may be reduced.

The thermal spraying conditions under which the yttrium fluoride sprayed coating is deposited are not particularly limited. Once the spray tool is charged with the powdered spray material mentioned above, any of plasma spraying, SPS spraying, detonation spraying and vacuum spraying may be carried out in a suitable atmosphere, while controlling the distance between the nozzle and the substrate and the spraying speed (gas species, gas flow rate). Spraying is continued until the desired thickness is reached. In the case of plasma spraying, helium gas may be used as the secondary gas because the use of helium gas allows the velocity of fused flame to be increased so that a denser coating is obtained.

The substrate on which the yttrium fluoride spray coating is deposited is not particularly limited. It is typically selected from metal and ceramic substrates used in the semiconductor device fabrication system. In the case of an aluminum metal substrate, an aluminum substrate having an anodized surface is acceptable for acid resistance.

While it is preferred that the sprayed coating have a crack amount and a porosity both of up to 5% based on the surface area thereof, such a low crack amount and a low porosity can be achieved using the spray material of the invention. The crack amount and porosity will be described later in detail.

In a cross section of a sprayed coating, there are present bonded sites, non-bonded sites and perpendicular fractures as described in "Spraying Technology Handbook" (Ed. by Spraying Society of Japan, published by Gijutsu Kaihatsu Center, May 1998). The perpendicular fractures are defined as open pores. Closed pores between bonded sites and non-bonded spaces do not allow for penetration of gas and acid water, whereas perpendicular fractures (or open pores) and horizontal fractures in non-bonded spaces (or open pores), which are in communication with the interface between the sprayed coating and the substrate, allow for penetration of gas and acid water to the substrate interface. If open pores (or perpendicular fractures) are present, the reactive gas penetrates to the sprayed coating-substrate interface. A reaction product formed at the coating surface reacts with water to generate an acid, which in turn, dissolves in water and penetrates into the bulk of the sprayed coating, eventually reacts with the substrate metal at the substrate interface to form a reaction gas, which acts to urge the sprayed coating afloat, causing the coating to peel. It is presumed that a similar series of actions take place with water or acid used for repetitive cleaning. The mechanisms are described below.

For etching of polysilicon gate electrodes during the dry etching step in the semiconductor fabrication process, a mixed gas plasma of $CCl_4$, $CF_4$, $CHF_3$, $NF_4$, etc. is used; for etching of Al wiring, a mixed gas plasma of $CCl_4$, $BCl_3$, $SiCl_4$, etc. is used; for etching of W wiring, a mixed gas plasma of $CF_4$, $CCl_4$, $O_2$, etc. is used. In the CVD process, a $SiH_2Cl_2$—$H_2$ mixed gas is used for Si film formation; a $SiH_2Cl_2$—$NH_3$—$H_2$ mixed gas is used for $Si_3N_4$ formation; and a $TiCl_4$—$NH_3$ mixed gas is used for TiN film formation.

In the case of chlorine base gas plasma used for Al wire etching, for example, aluminum reacts with chlorine to form aluminum chloride ($AlCl_3$), which adheres to the sprayed coating surface as a deposit. The deposit along with water penetrates into the bulk of the sprayed coating, and accumulates at the interface between the sprayed coating and the aluminum substrate. Then, accumulation of aluminum chloride occurs at the interface during cleaning and drying. Aluminum chloride reacts with water to convert to aluminum hydroxide and to create hydrochloric acid. The hydrochloric acid reacts with the underlying aluminum metal to generate hydrogen gas, which acts to urge the sprayed coating at the interface afloat to induce partial breaks to the sprayed coating, causing the coating to peel. That is, a so-called film floating phenomenon occurs. At film floating sites, an extreme drop of bond strength occurs. All the cause for these failures is that cracks (fractures) at the surface of the sprayed coating and open pores (perpendicular fractures) in the bulk of the sprayed coating are in continuous communication down to the substrate interface. The reaction product (or deposit) $AlCl_3$ at the coating surface undergoes the following reactions down to the substrate interface.

$$AlCl_3+3H_2O \rightarrow Al(OH)_3+3HCl$$

$$Al+3HCl \rightarrow AlCl_3+(3/2)H_2\uparrow$$

Once the film floating phenomenon occurs, the substrate is damaged and the substrate life is shortened, giving various adverse effects to the fabrication process. According to the invention, cracks (fractures) at the coating surface and open pores (perpendicular fractures) in the coating bulk may be minimized. As mentioned above, the invention is successful in reducing the crack amount and porosity to or below 5%, thereby preventing penetration of gas, acid water and reaction product from the sprayed coating surface, thus inhibiting reaction of acid with metal at the sprayed coating-substrate interface, and eventually preventing coating peel. As used herein, the "crack" associated with the "crack amount" refers to cracks present at the outermost surface of a coating immediately after spraying, and the "pore" associated with the "porosity" refers to pores appearing in a cross section of a sprayed coating after mirror finish polishing, inclusive of both open and closed pores. The crack amount and porosity may be determined as follows. Notably, since it is difficult in a substantial sense to measure only open pores, the porosity relating to both open and closed pores is measured in the practice of the invention. As long as the porosity thus measured is 5% or less, the occurrence of failure due to open pores can be almost inhibited.

From the outermost surface of a coating immediately after spraying (in the case of crack amount measurement) or a surface of the sprayed coating after mirror finish polishing (in the case of porosity measurement), several to several ten spots (typically about 5 to about 10 spots) are selected, an electron microscope photograph is taken at each spot over a region having an area of about 0.001 to 0.1 $mm^2$, each photograph is image processed, a proportion (%) of areas of cracks or a proportion (%) of areas of open and closed pores relative to the region area is computed. An average is reported as crack amount or porosity.

An yttrium fluoride sprayed coating having a low porosity may be effectively deposited by using the fired powder (single granulated powder) or the powder mixture, both defined above, as the spray material, and/or by using detonation spraying or suspension plasma spraying (SPS) as the thermal spraying technique. Specifically, in the case of plasma spraying, the flame velocity is about 300 m/sec when the secondary gas is hydrogen or about 500 to 600 m/sec when the secondary gas is helium gas. In the case of detonation spraying, a flame velocity of about 1,000 to 2,500 m/sec is available, which means that a high level of energy is obtained when a flame of fused spray powder impinges against the substrate at a high velocity, ensuring to form a sprayed coating having a high hardness and a high density and containing less open pores. In the case of SPS, since single particles have a particle size ($D_{50}$) which is as small as about 1 μm, the residual stress within splats may be reduced. This achieves a size reduction of micro-cracks (fractures) in the coating surface and open pores (perpendicular fractures) in the coating bulk whereby the crack amount is minimized.

Using these measures, a dense coating containing less open pores is obtained while suppressing particle contamination and penetration of halogen-base corrosive gas. This prevents penetration of acid generated by reaction of water with the reaction product and penetration of water during precise cleaning, and protects the member from damages so that the member may have a longer lifetime.

The yttrium fluoride sprayed coating may be formed on the surface of substrates of metals or ceramics used in the semiconductor fabrication system, thereby endowing the substrates with improved corrosion resistance and preventing particle generation. By further combining the yttrium fluoride sprayed coating with a lower layer in the form of a sprayed coating of rare earth oxide, a corrosion resistant coating of multilayer structure is obtained. The multilayer coating is more effective for suppressing acid penetration and more resistant to damages, offering more reliable corrosion resistant performance.

The rare earth element in the rare earth oxide sprayed coating to constitute the lower layer is preferably selected from among Y, Sc, La, Ce, Pr, Nd, Sm, Eu, Gd, Tb, Dy, Ho, Er, Tm, Yb and Lu, and mixtures thereof, more preferably from among Y, Sc, Gd, Tb, Dy, Ho, Er, Tm, Yb and Lu, and mixtures thereof.

The lower layer may be formed by thermally spraying an oxide of the rare earth element to a substrate surface. The yttrium fluoride sprayed coating is formed on the lower layer in a stacking manner, yielding a corrosion resistant composite coating. Also the lower layer has a porosity of preferably up to 5%, more preferably up to 3%, based on the surface area of the coating. Such a low porosity may be achieved by the following method, for example, although the method is not particularly limited.

A dense rare earth oxide sprayed coating having a porosity of up to 5% and containing less open pores may be formed by using a single particle powder having a particle size ($D_{50}$) of 0.5 to 30 μm, preferably 1 to 20 μm, as the source powder for the rare earth oxide, and performing plasma spraying, SPS spraying or detonation spraying so that single particles may be fully fused and sprayed. Since the single particle powder used as the spray material consists of fine particles of solid interior having a smaller particle size than the conventional granulated spray powder, splats become of smaller diameter and less cracks are generated. These effects ensure to form a sprayed coating having a porosity of up to 5%, with extremely less open pores, and a low surface roughness. It is noted that "single particle powder" is a powder of spherical particles, angular particles, or ground particles of solid interior.

EXAMPLE

Examples of the invention are given below by way of illustration and not by way of limitation.

Example 1

A 6061 aluminum alloy substrate of 20 mm squares and 5 mm thick was degreased on their surfaces with acetone and roughened on one surface with corundum abrasive grains. On the roughened surface of the substrate, an yttrium oxide sprayed coating of 100 μm thick was deposited as the lower layer by using an atmospheric plasma spraying system, yttrium oxide powder (single angular particles) having an average particle size ($D_{50}$) of 8 μm, and argon and hydrogen gases as the plasma gas, and operating the system at a power of 40 kW, a spray distance of 100 mm, and a buildup of 30 μm/pass. On image analysis, the lower layer had a porosity of 3.2%. The porosity measuring method is the same as the measurement of a porosity of a surface layer to be described below.

Separately, a spray powder (spray material) was prepared by mixing 95 wt % of yttrium fluoride powder A having an average particle size ($D_{50}$) of 1 μm with 5 wt % of yttrium oxide powder B having an average particle size ($D_{50}$) of 0.2 μm, granulating the mixture by spray drying, and firing at 800° C. in a nitrogen gas atmosphere. The spray powder thus obtained was measured for an average particle size ($D_{50}$), bulk density, and angle of repose, with the results shown in Table 1. The spray powder was also analyzed by XRD, finding that it consisted of $YF_3$ and $Y_5O_4F_7$, with a content of $Y_5O_4F_7$ being 9.1 wt %, as shown in Table 1. The spray powder (spray material) was plasma sprayed on the lower layer of the yttrium oxide sprayed coating under the same conditions as used for the lower layer deposition. In this way, an yttrium fluoride sprayed coating of 100 μm thick was deposited as a surface layer on the lower layer, yielding a corrosion resistant coating of two-layer structure having an overall thickness of 200 μm as a specimen.

The surface layer of the yttrium fluoride sprayed coating was analyzed by XRD, finding that it had an yttrium fluoride crystal structure consisting of $YF_3$ and $Y_5O_4F_7$. The surface layer or sprayed coating was measured for surface roughness Ra, Y concentration, F concentration, O concentration, C concentration, surface crack amount, porosity, and hardness HV. The results are shown in Table 1. The crack amount, porosity and hardness were measured by the following methods.

Measurement of Crack Amount on Surface

For each specimen, a surface photograph (magnification 3000×) was taken under an electron microscope. Images were taken over 5 fields of view (imaging area of one field: 0.0016 $mm^2$), followed by image processing by the image processing software Photoshop (Adobe Systems). Using image analysis software Scion Image (Scion Corporation), the crack amount was quantitated. An average crack amount of 5 fields is computed as a percentage relative to the total image area, with the result shown in Table 1.

Measurement of Porosity

Each specimen was embedded in a resin support. A cross section was polished to a mirror finish (Ra=0.1 μm). A cross section photograph (magnification 200×) was taken under an electron microscope. Images were taken over 10 fields of view (imaging area of one field: 0.017 $mm^2$), followed by image processing by the image processing software Photoshop (Adobe Systems). Using image analysis software Scion Image (Scion Corporation), the porosity was quantitated. An average porosity of 10 fields is computed as a percentage relative to the total image area, with the result shown in Table 1.

Measurement of Hardness HV

Each specimen was polished on its surface and cross section to a mirror finish (Ra=0.1 μm). Using Micro Vickers hardness tester, the hardness of the coating surface was measured at 3 points. An average value was reported as coating surface hardness, with the result shown in Table 1.

Example 2

A 6061 aluminum alloy substrate of 20 mm squares and 5 mm thick was degreased on their surfaces with acetone and roughened on one surface with corundum abrasive grains. On the roughened surface of the substrate, an yttrium oxide sprayed coating of 100 μm thick was deposited as the lower layer by using an atmospheric plasma spraying system, yttrium oxide powder (granulated powder) having an average particle size ($D_{50}$) of 20 μm, and argon and hydrogen gases as the plasma gas, and operating the system at a power of 40 kW, a spray distance of 100 mm, and a buildup of 30 μm/pass. On image analysis as in Example 1, the lower layer had a porosity of 2.8%.

Separately, a spray powder (spray material) was prepared by mixing 90 wt % of yttrium fluoride powder A having an average particle size ($D_{50}$) of 1.7 μm with 10 wt % of yttrium oxide powder B having an average particle size ($D_{50}$) of 0.3 μm, granulating the mixture by spray drying, and firing at 800° C. in a nitrogen gas atmosphere. The spray powder thus obtained was measured for an average particle size ($D_{50}$), bulk density, and angle of repose, with the results shown in Table 1. The spray powder was also analyzed by XRD, finding that it consisted of $YF_3$ and $Y_5O_4F_7$, with a content of $Y_5O_4F_7$ being 17.3 wt %, as shown in Table 1. The spray powder (spray material) was plasma sprayed on the lower layer of the yttrium oxide sprayed coating under the same conditions as used for the lower layer deposition. In this way, an yttrium fluoride sprayed coating of 100 μm thick was deposited as a surface layer on the lower layer, yielding a corrosion resistant coating of two-layer structure having an overall thickness of 200 μm as a specimen.

The surface layer of the yttrium fluoride sprayed coating was analyzed by XRD, finding that it had an yttrium fluoride crystal structure consisting of $YF_3$ and $Y_5O_4F_7$. The surface layer or sprayed coating was measured for surface roughness Ra, Y, F, O, C concentrations, surface crack amount, porosity, and hardness as in Example 1. The results are shown in Table 1.

Example 3

An alumina ceramic substrate of 20 mm squares and 5 mm thick was degreased on their surfaces with acetone and roughened on one surface with corundum abrasive grains. On the roughened surface of the substrate, an yttrium oxide sprayed coating of 100 μm thick was deposited as the lower layer by using a detonation spraying system, yttrium oxide powder having an average particle size ($D_{50}$) of 30 μm, and oxygen and ethylene gases, and operating the system at a spray distance of 100 mm and a buildup of 15 μm/pass. On image analysis as in Example 1, the lower layer had a porosity of 1.8%.

Separately, a spray powder (spray material) was prepared by mixing 85 wt % of yttrium fluoride powder A having an average particle size ($D_{50}$) of 1.4 μm with 15 wt % of yttrium oxide powder B having an average particle size ($D_{50}$) of 0.5 μm on a ball mill, and firing at 800° C. in a nitrogen gas atmosphere. The spray powder thus obtained was measured for an average particle size ($D_{50}$), with the result shown in Table 1. The spray powder was also analyzed by XRD, finding that it consisted of $YF_3$ and $Y_5O_4F_7$, with a content of $Y_5O_4F_7$ being 26.4 wt %, as shown in Table 1. The spray powder (spray material) was dispersed in deionized water to form a slurry having a concentration of 30 wt %. The slurry was SPS sprayed on the lower layer of the yttrium oxide sprayed coating by using an atmospheric plasma spraying system, argon, nitrogen and hydrogen gases as the plasma gas, and operating the system at a power of 100 kW, a spray distance of 70 mm, and a buildup of 30 μm/pass. In this way, an yttrium fluoride sprayed coating of 100 μm thick was deposited as a surface layer on the lower layer, yielding a corrosion resistant coating of two-layer structure having an overall thickness of 200 μm as a specimen.

The surface layer of the yttrium fluoride sprayed coating was analyzed by XRD, finding that it had an yttrium fluoride crystal structure consisting of $YF_3$, YOF and $Y_2O_3$. The surface layer or sprayed coating was measured for surface roughness Ra, Y, F, O, C concentrations, surface crack amount, porosity, and hardness as in Example 1. The results are shown in Table 1.

Example 4

A 6061 aluminum alloy substrate of 20 mm squares and 5 mm thick was degreased on their surfaces with acetone and roughened on one surface with corundum abrasive grains. On the roughened surface of the substrate, an yttrium oxide sprayed coating of 100 μm thick was deposited as the lower layer by using an atmospheric plasma spraying system, yttrium oxide powder (spherical single particles) having an average particle size ($D_{50}$) of 18 μm, and argon and hydrogen gases as the plasma gas, and operating the system at a power of 40 kW, a spray distance of 100 mm, and a buildup of 30 μm/pass. On image analysis as in Example 1, the lower layer had a porosity of 2.8%.

Separately, a spray powder (spray material) was prepared by mixing yttrium fluoride granulated powder A having an average particle size ($D_{50}$) of 45 μm and yttrium oxide granulated powder B having an average particle size ($D_{50}$) of 40 μm in a weight ratio of 90:10 to form a powder mixture. The spray powder was measured for an average particle size ($D_{50}$), bulk density, and angle of repose, with the results shown in Table 1. The spray powder was also analyzed by XRD, finding that it was a mere mixture of $YF_3$ and $Y_2O_3$. The spray powder (spray material) was plasma sprayed on the lower layer of the yttrium oxide sprayed coating under the same conditions as used for the lower layer deposition. In this way, an yttrium fluoride sprayed coating of 100 μm thick was deposited as a surface layer on the lower layer, yielding a corrosion resistant coating of two-layer structure having an overall thickness of 200 μm as a specimen.

The surface layer of the yttrium fluoride sprayed coating was analyzed by XRD, finding that it had an yttrium fluoride crystal structure consisting of $YF_3$, $Y_5O_4F_7$, and $Y_2O_3$. The surface layer or sprayed coating was measured for surface roughness Ra, Y, F, O, C concentrations, surface crack amount, porosity, and hardness as in Example 1. The results are shown in Table 1.

Comparative Example 1

A 6061 aluminum alloy substrate of 20 mm squares and 5 mm thick was degreased on their surfaces with acetone and roughened on one surface with corundum abrasive grains. On the roughened surface of the substrate, an yttrium oxide sprayed coating of 100 μm thick was deposited as the lower layer by using an atmospheric plasma spraying system, yttrium oxide powder (granulated powder) having an average particle size ($D_{50}$) of 20 μm, and argon and hydrogen gases as the plasma gas, and operating the system at a power of 40 kW, a spray distance of 100 mm, and a buildup of 30 μm/pass. On image analysis as in Example 1, the lower layer had a porosity of 2.8%.

Next, using yttrium fluoride granulated powder A having an average particle size ($D_{50}$) of 40 μm alone as the spray material, plasma spraying was performed under the same conditions as used for the lower layer deposition. In this way, an yttrium fluoride sprayed coating of 100 μm thick was deposited as a surface layer on the lower layer of the yttrium oxide sprayed coating, yielding a corrosion resistant coating of two-layer structure having an overall thickness of 200 μm as a specimen. As in Example 1, the spray powder was measured for bulk density and angle of repose. The surface layer of the yttrium fluoride sprayed coating was analyzed by XRD and measured for surface roughness Ra, Y, F, O, C concentrations, surface crack amount, porosity, and hardness as in Example 1. The results are shown in Table 1.

Comparative Example 2

A 6061 aluminum alloy substrate of 20 mm squares and 5 mm thick was degreased on their surfaces with acetone and roughened on one surface with corundum abrasive grains. By using an atmospheric plasma spraying system, yttrium fluoride granulated powder A having an average particle size ($D_{50}$) of 30 μm, and argon and hydrogen gases as the plasma gas, and operating the system at a power of 40 kW, a spray distance of 100 mm, and a buildup of 30 μm/pass, an yttrium fluoride sprayed coating of 200 μm thick was deposited on the roughened surface of the substrate. A corrosion resistant coating in the form of a monolayer yttrium fluoride sprayed coating was obtained as a specimen.

As in Example 1, the spray powder was measured for bulk density and angle of repose, and the yttrium fluoride sprayed coating was analyzed by XRD and measured for surface roughness Ra, Y, F, O, C concentrations, surface crack amount, porosity, and hardness. The results are shown in Table 1.

Comparative Example 3

A 6061 aluminum alloy substrate of 20 mm squares and 5 mm thick was degreased on their surfaces with acetone and roughened on one surface with corundum abrasive grains. On the roughened surface of the substrate, an yttrium oxide sprayed coating of 100 μm thick was deposited as the lower layer by using an atmospheric plasma spraying system, yttrium oxide powder (granulated powder) having an average particle size ($D_{50}$) of 20 μm, and argon and hydrogen gases as the plasma gas, and operating the system at a power of 40 kW, a spray distance of 100 mm, and a buildup of 30 μm/pass. On image analysis as in Example 1, the lower layer had a porosity of 2.8%.

Separately, a spray powder (spray material) was prepared by mixing 65 wt % of yttrium fluoride powder A having an average particle size ($D_{50}$) of 1 μm with 35 wt % of yttrium oxide powder B having an average particle size ($D_{50}$) of 0.2 μm, granulating the mixture by spray drying, and firing at 800° C. in a nitrogen gas atmosphere. The spray powder thus obtained was measured for an average particle size ($D_{50}$), bulk density, and angle of repose, with the results shown in Table 1. The spray powder was also analyzed by XRD, finding that it consisted of $YF_3$ and $Y_5O_4F_7$, with a content of $Y_5O_4F_7$ being 49.8 wt %, as shown in Table 1. The spray powder (spray material) was plasma sprayed on the lower layer of the yttrium oxide sprayed coating under the same conditions as used for the lower layer deposition. In this way, an yttrium fluoride sprayed coating of 100 μm thick was deposited as a surface layer on the lower layer, yielding a corrosion resistant coating of two-layer structure having an overall thickness of 200 μm as a specimen.

The surface layer of the yttrium fluoride sprayed coating was analyzed by XRD, finding that it had an yttrium fluoride crystal structure consisting of YOF, $Y_5O_4F_7$, and $Y_7O_6F_9$. The surface layer or sprayed coating was measured for surface roughness Ra, Y, F, O, C concentrations, surface crack amount, porosity, and hardness as in Example 1. The results are shown in Table 1.

Comparative Example 4

A 6061 aluminum alloy substrate of 20 mm squares and 5 mm thick was degreased on their surfaces with acetone and roughened on one surface with corundum abrasive grains. On the roughened surface of the substrate, an yttrium oxide sprayed coating of 100 μm thick was deposited as the lower layer by using an atmospheric plasma spraying system, yttrium oxide powder (granulated powder) having an average particle size ($D_{50}$) of 20 μm, and argon and hydrogen gases as the plasma gas, and operating the system at a power of 40 kW, a spray distance of 100 mm, and a buildup of 30 μm/pass. On image analysis as in Example 1, the lower layer had a porosity of 2.8%.

Separately, a spray powder (spray material) was prepared by mixing 50 wt % of yttrium fluoride powder A having an average particle size ($D_{50}$) of 1 μm with 50 wt % of yttrium oxide powder B having an average particle size ($D_{50}$) of 0.2 μm, granulating the mixture by spray drying, and firing at 800° C. in a nitrogen gas atmosphere. The spray powder thus obtained was measured for an average particle size ($D_{50}$), bulk density, and angle of repose, with the results shown in Table 1. The spray powder was also analyzed by XRD, finding that it consisted of $YF_3$, $Y_5O_4F_7$, and $Y_2O_3$, with a content of $Y_5O_4F_7$ being 59.1 wt %, as shown in Table 1. The spray powder (spray material) was plasma sprayed on the lower layer of the yttrium oxide sprayed coating under the same conditions as used for the lower layer deposition. In this way, an yttrium fluoride sprayed coating of 100 μm thick was deposited as a surface layer on the lower layer, yielding a corrosion resistant coating of two-layer structure having an overall thickness of 200 μm as a specimen.

The surface layer of the yttrium fluoride sprayed coating was analyzed by XRD, finding that it had an yttrium fluoride crystal structure consisting of YOF and $Y_5O_4F_7$. The surface layer or sprayed coating was measured for surface roughness Ra, Y, F, O, C concentrations, surface crack amount, porosity, and hardness as in Example 1. The results are shown in Table 1.

The specimens of Examples 1 to 4 and Comparative Examples 1 to 4 were examined by the following tests to evaluate particle generation and plasma corrosion resistance. The results are shown in Table 1.

Particle Generation Evaluation Test

Each specimen was subjected to ultrasonic cleaning (power 200 W, time 30 minutes), dried, and immersed in 20 cc of ultrapure water where it was again subjected to ultrasonic cleaning for 15 minutes. After ultrasonic cleaning, the specimen was taken out, 2 cc of 5.3N nitric acid was added to the ultrapure water to dissolve $Y_2O_3$ microparticles (borne in the ultrapure water). A quantitative value of $Y_2O_3$ was measured by ICP-AES. The results are shown in Table 1.

Corrosion Resistance Test

Each specimen was surface polished to a mirror finish (Ra=0.1 μm) and masked with masking tape to define a masked section and an exposed section. The specimen was set in a reactive ion plasma tester, where a plasma corrosion resistance test was carried out under conditions: frequency 13.56 MHz, plasma power 1,000 W, gas species $CF_4$+$O_2$ (20 vol %), flow rate 50 sccm, gas pressure 50 mTorr, and time 20 hours. Under a laser microscope, the height of a step formed between the masked and exposed sections by corrosion was measured. An average value from measurements at 4 points was reported as an index of corrosion resistance. The results are shown in Table 1.

TABLE 1

| | Example | | | | Comparative Example | | | |
|---|---|---|---|---|---|---|---|---|
| | 1 | 2 | 3 | 4 | 1 | 2 | 3 | 4 |
| Source A | $YF_3$ | $YF_3$ | $YF_3$ | $YF_3$ | $YF_3$ | $YF_3$ | $YF_3$ | $YF_3$ |
| Source B | $Y_2O_3$ | $Y_2O_3$ | $Y_2O_3$ | $Y_2O_3$ | $Y_2O_3$ | $Y_2O_3$ | $Y_2O_3$ | $Y_2O_3$ |
| Source mixing A:B (wt %) | 95:5 | 90:10 | 85:15 | 90:10 | 100:0 | 100:0 | 65:35 | 50:50 |
| Particle size $D_{50}$ of spray powder (μm) | 46 | 43 | 1.1 | 44 | 44 | 48 | 42 | 45 |
| Bulk density of spray powder (g/cm$^3$) | 1.4 | 1.5 | — | 1.6 | 2.3 | 1.4 | 1.7 | 1.6 |
| Repose angle of spray powder (°) | 34 | 34 | — | 35 | 32 | 30 | 39 | 32 |
| XRD of spray powder | $YF_3$, $Y_5O_4F_7$ | $YF_3$, $Y_5O_4F_7$ | $YF_3$, $Y_5O_4F_7$ | $YF_3$, $Y_2O_3$ | $YF_3$ | $YF_3$ | $YF_3$, $Y_5O_4F_7$ | $YF_3$, $Y_5O_4F_7$, $Y_2O_3$ |

TABLE 1-continued

| | Example | | | | Comparative Example | | | |
|---|---|---|---|---|---|---|---|---|
| | 1 | 2 | 3 | 4 | 1 | 2 | 3 | 4 |
| $Y_5O_4F_7$ content in spray powder (wt %) | 9.1 | 17.3 | 26.4 | 0 | 0 | 0 | 49.8 | 59.1 |
| Spraying technique of lower layer | plasma | plasma | detonation | plasma | plasma | — | plasma | plasma |
| Spraying technique of surface layer | plasma | plasma | SPS | plasma | plasma | plasma | plasma | plasma |
| Surface roughness Ra of surface sprayed coating (μm) | 5.5 | 3.7 | 1.0 | 3.9 | 7 | 4.9 | 6.3 | 5 |
| Y concentration of surface sprayed coating (wt %) | 62.8 | 62.5 | 64.2 | 62.8 | 61 | 60.9 | 67.3 | 70.3 |
| F concentration of surface sprayed coating (wt %) | 33.6 | 31.7 | 29.6 | 31.2 | 37.2 | 36.5 | 23.3 | 16.3 |
| O concentration of surface sprayed coating (wt %) | 2.1 | 3.4 | 4.8 | 3.3 | 0.58 | 1.1 | 7.5 | 10.5 |
| C concentration of surface sprayed coating (wt %) | <0.005 | <0.005 | <0.005 | <0.005 | <0.005 | 0.013 | <0.005 | <0.005 |
| XRD of surface sprayed coating | $YF_3$, $Y_5O_4F_7$ | $YF_3$, $Y_5O_4F_7$ | YOF, $YF_3$, $Y_2O_3$ | $YF_3$, $Y_5O_4F_7$, $Y_2O_3$ | $YF_3$ | $YF_3$ | YOF, $Y_5O_4F_7$, $Y_7O_6F_9$ | YOF, $Y_5O_4F_7$ |
| Crack amount of surface sprayed coating (%) | 4 | 3 | 1 | 0.5 | 6 | 7 | 9 | 11 |
| Porosity of surface sprayed coating (%) | 2 | 2.1 | 0.1 | 2.3 | 3.5 | 3.7 | 6 | 7 |
| Hardness of surface sprayed coating (HV) | 470 | 390 | 350 | 370 | 230 | 200 | 180 | 150 |
| Amount of Y particles from surface sprayed coating (μg) | ≤7 | ≤7 | 18 | ≤7 | 50 | 60 | 50 | 100 |
| Average step height of surface sprayed coating as index of corrosion resistance | 3.7 μm | 3.5 μm | 4.1 μm | 3.6 μm | 5.0 μm | 5.5 μm | 4.7 μm | 5.3 μm |

Figure 2:
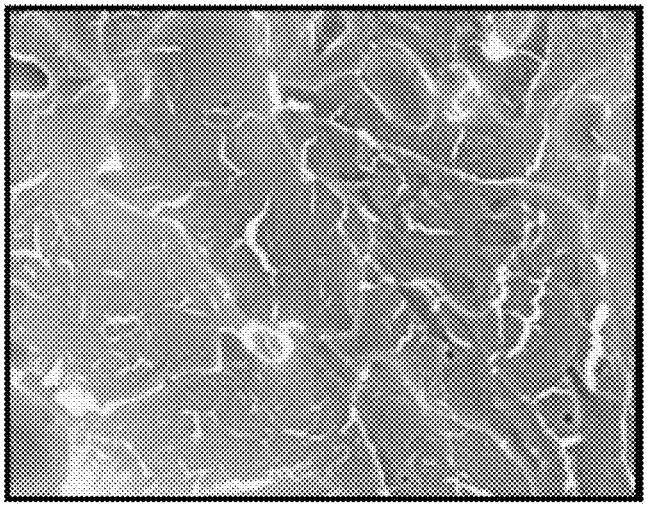
FIG. 2 is a partial enlarged view of the micrograph of FIG. 1, processed so as to emphasize cracks.
Figure 3:
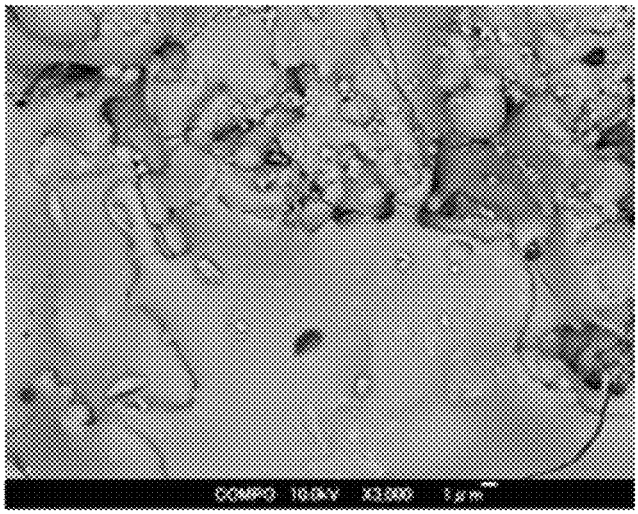
FIG. 3 is an electron micrograph showing a surface of an yttrium fluoride sprayed coating deposited in Example 2.
Figure 4:
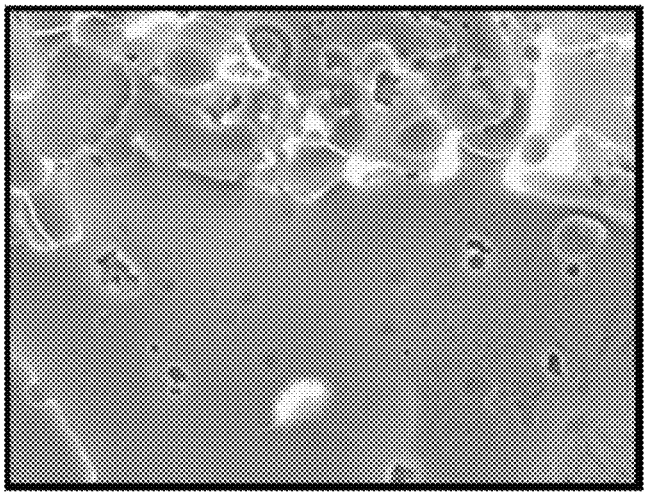
FIG. 4 is a partial enlarged view of the micrograph of FIG. 3, processed so as to emphasize cracks.

As is evident from Table 1, the yttrium fluoride sprayed coatings of Examples 1 to 4 are hard dense coatings containing less cracks and less open pores than those of Comparative Examples 1 to 4. FIGS. 1 and 2 are analytic image photographs on surface of the sprayed coating in Comparative Example 1; FIGS. 3 and 4 are analytic image photographs on surface of the sprayed coating in Example 2. A comparison of FIGS. 1 and 2 with FIGS. 3 and 4 reveals that the sprayed coating of the invention contains extremely less cracks than the conventional coating.

The corrosion resistant coatings in Examples 1 to 4 including the yttrium fluoride sprayed coating as a surface layer are effective for preventing spall-off particles from generating because the amount of $Y_2O_3$ dissolved in the particle generation evaluation test is noticeably small as compared with the coatings of Comparative Examples 1 to 4. The corrosion resistant coatings in Examples 1 to 4 have satisfactory corrosion resistance to plasma etching because the height of a step generated by corrosion in the corrosion resistance test is significantly small as compared with the coatings of Comparative Examples 1 to 4.

Japanese Patent Application No. 2016-079258 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An yttrium fluoride sprayed coating deposited on a substrate surface, having an yttrium fluoride crystal structure composed of $YF_3$ and at least one compound selected from the group consisting of $Y_5O_4F_7$, YOF and $Y_2O_3$, a thickness of 10 to 500 μm, an oxygen concentration of 1 to 4.8% by weight, and a hardness of at least 350 HV.

2. The sprayed coating of claim 1, having a crack amount of up to 5% based on the surface area of the coating.

3. The sprayed coating of claim 1, having a porosity of up to 5% based on the surface area of the coating.

4. The sprayed coating of claim 1, having a carbon content of up to 0.01% by weight.

5. The sprayed coating of claim 1, having a carbon content of up to 0.005% by weight.

6. The sprayed coating of claim 1, having an oxygen concentration of 2 to 4.8% by weight.

7. The sprayed coating of claim 1, having an yttrium fluoride crystal structure composed of $YF_3$ and at least one compound selected from the group consisting of $Y_5O_4F_7$ and YOF.

8. The sprayed coating of claim 1, having an yttrium fluoride crystal structure composed of $YF_3$, $Y_2O_3$, and at least one compound selected from the group consisting of $Y_5O_4F_7$, YOF.

9. An yttrium fluoride sprayed coating deposited on a substrate surface, having an yttrium fluoride crystal structure composed of $YF_3$ and at least one compound selected from the group consisting of $Y_5O_4F_7$, YOF and $Y_2O_3$, a thickness of 10 to 500 μm, an oxygen concentration of 1 to 6% by weight, a carbon content of up to 0.005% by weight, and a hardness of at least 350 HV.

10. The sprayed coating of claim 9, having a crack amount of up to 5% based on the surface area of the coating.

11. The sprayed coating of claim 9, having a porosity of up to 5% based on the surface area of the coating.

12. The sprayed coating of claim 9, having an oxygen concentration of 1 to 4.8% by weight.

13. The sprayed coating of claim 9, having an oxygen concentration of 2 to 4.8% by weight.

14. The sprayed coating of claim 9, having an yttrium fluoride crystal structure composed of $YF_3$ and at least one compound selected from the group consisting of $Y_5O_4F_7$ and YOF.

15. The sprayed coating of claim 9, having an yttrium fluoride crystal structure composed of $YF_3$, $Y_2O_3$, and at least one compound selected from the group consisting of $Y_5O_4F_7$, YOF.

* * * * *